United States Patent [19]

Pardini et al.

[11] Patent Number: 4,492,836

[45] Date of Patent: Jan. 8, 1985

[54] ARC MOTIVATING ASSEMBLY FOR CIRCUIT BREAKERS

[75] Inventors: Franco P. Pardini, Milan; Francesco De Vizzi, San Giuliano, both of Italy

[73] Assignee: General Electric Company, New York, N.Y.

[21] Appl. No.: 470,678

[22] Filed: Feb. 28, 1983

[30] Foreign Application Priority Data

May 25, 1982 [IT] Italy ..... 21463 A/82

[51] Int. Cl.[3] ..... H01H 33/00

[52] U.S. Cl. ..... 200/144 R; 200/149 A

[58] Field of Search ..... 200/144 R, 148 C, 149 A, 200/147 B

[56] References Cited

U.S. PATENT DOCUMENTS

| | | | |
|---|---|---|---|
| 2,082,028 | 6/1937 | Rawlins | 200/149 A |
| 2,707,218 | 4/1955 | Cellerini | 200/144 R |
| 4,375,021 | 2/1983 | Pardini et al. | 200/147 B |

*Primary Examiner*—Harry E. Moose, Jr.
*Assistant Examiner*—Morris Ginsburg
*Attorney, Agent, or Firm*—R. A. Menelly; W. C. Bernkopf; Fred Jacob

[57] ABSTRACT

An arc motivating assembly positioned on both sides of a pair of circuit breaker contacts is coated with electrical insulating material arranged in alternate layers of two different compositions. The first is selected to have good electrical insulation and high arc resistance, and the second is selected for vaporizing and generating gases to assist in arc blow out and extinction.

6 Claims, 3 Drawing Figures

ARC MOTIVATING ASSEMBLY FOR CIRCUIT BREAKERS

BACKGROUND OF THE INVENTION

This invention is related to the subject matter of U.S. Pat. No. 4,375,021 entitled "Rapid Electric Arc Extinguishing Assembly in Circuit Breaking Devices Such As Electric Circuit Breakers," issued Feb. 22, 1983 and assigned to the Assignee of the instant invention, which application is incorporated herein for purposes of reference. This invention relates in general to the magnetic motoring assembly shown at FIG. 1 in the aforementioned Patent and, in particular, to the insulating material forming a coating and filling the gaps existing between the plates of magnetic material of the side magnetic assembly, in such a manner as to form an arc as described in the aforementioned patent, and also to the arc motivating assembly shown at FIG. 12, particularly the material forming the two columns flanking the side assembly.

One problem described within the aforementioned patent was that the insulating material forming the columns of the assembly, must satisfy two contradictory requirements, namely, a high electrical insulation and a high arc resistance while at the same time contribute substantially to the blow out and extinction of the arc by the vaporization of gases. Unfortunately, the insulating substances known in the art will either provide the high insulation coefficient and high arc resistance, while slightly contributing to the blow out and extinction of the arc, or they vaporize and contribute to the blow out and extinction of the arc but are incapable of maintaining their properties after exposure to the arc.

One of the main objects of this invention is to provide the insulation which is necessary between the contacts of a circuit breaker when the contacts are open and, at the same time, to develop effective blow out and extinction of the arcing between the contacts when opened.

SUMMARY OF THE INVENTION

The insulating material forming a coating and filling the gaps existing between the plates of magnetic material which compromise the magnetic or side assembly is selected and arranged in such a manner as to contribute to the extinction of the arc by vaporization and emission of gas and, at the same time, to prevent formation of flame and the conductive paths which can decrease the insulation required between the contacts when they are opened.

In particular, the insulating material is selected from two different types and, in one embodiment of the invention, is arranged with at least two alternate layers on the columns of the magnetic assembly. The first material has a high dielectric strength and a high arc resistance while incapable of emitting gas to assist in the blow out and extinction of the arc. However this material does not form paths of low electrical resistance which would decrease the necessary insulation between the open contacts of the circuit breaker. The second material does actively contribute to the blow out and extinction of the arc by vaporization and emission of gas without having to maintain its insulating properties after exposure to the arc, since it is not relied upon to maintain the insulation between the open contacts.

According to another embodiment of the invention, the two types of insulating material are arranged in three alternative layers consisting of two end layers of the first material separated by an intermediate layer of the second material. In this embodiment, the second material is positioned opposite the location where the arcing occurs for immediately contributing to the blow out and extinguishing the arc upon the instance of arc formation. The two end layers of the first material of the first type provide the necessary insulation between the open contacts.

According to a further embodiment of the invention, the two types of insulating material are alternated to form a plurality of layers in order to allow a distribution of both the arc blow out and extinction property and the electrical insulating property along the entire length of the columns of the magnetic assembly.

BRIEF DESCRIPTION OF THE DRAWINGS

The above and other objects of the invention along with its advantages will be better understood from the following detailed description taken in conjunction with the accompanying drawings wherein.

DESCRIPTION OF THE EMBODIMENTS

Figure 1:
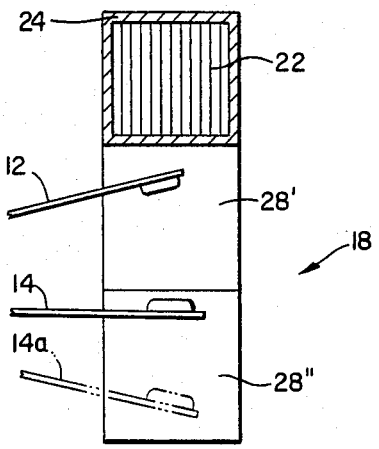
FIG. 1 is a cross-section view of a circuit breaker magnetic assembly containing a first embodiment of the coating arrangement of the invention.
Figure 2:
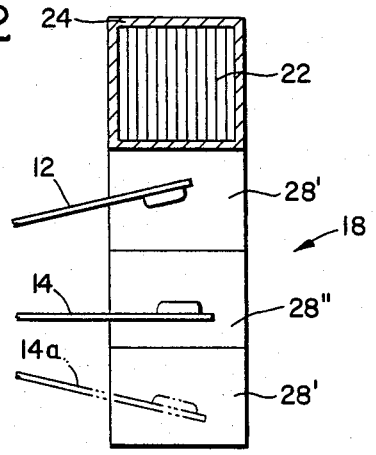
FIG. 2 is a cross-section view of a circuit breaker magnetic assembly containing a second embodiment of the coating arrangement of the invention.
Figure 3:
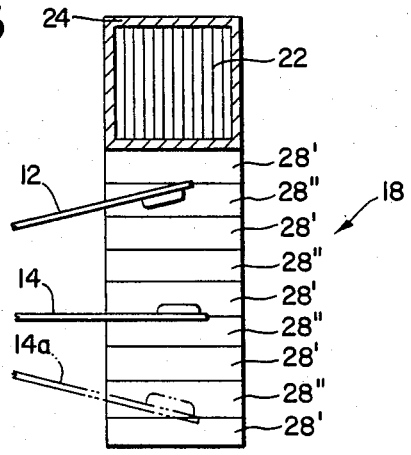
FIG. 3 is a cross-section view of a circuit breaker magnetic assembly containing a third embodiment of the coating arrangement of the invention.

As is shown in FIGS. 1-3, a pair of contacts, comprising a movable contact 12 and a stationary (or semi-stationary) contact 14, is flanked by a magnetic assembly 18. The side assembly is usually flanked by a magnetic yoke consisting of laminations 22 coated with insulating material 24, and, as described in the aforementioned U.S. Patent comprises a pair of opposed columns, each of which consists of plates of coated ferromagnetic material embedded in insulating resinous material indicated at 28' and 28" although only one column is shown in the figures.

According to the invention, the resinous material is of two different types. The first indicated at 28' is a material such as silicone rubber with high dielectric strength and high arc resistance which, under the influence of the arc, may or may not emit gas for extinction of the arc but, must not form tracks of low electrical resistance which would decrease the required insulation between the open contacts. The type indicated at 28" contributes to the extinction of the arc by vaporization and emission of gas during arcing, while not having to maintain its insulating properties after the arc is extinguished since it is not required to sustain the insulation between the open contacts.

The arrangements and the distributions of the material illustrated at 28" will therefore allow insulating materials of different compositions to be arranged close to the contacts without interfering with their mechanical operation, in such a manner as to attain the highest efficacy for the extinction of the arc.

The preferred material, indicated at 28", is a flame-retarding halogen-free polypropylene, for example, having flame-retarding properties by silica-based additives which, upon combustion, will not develop toxic or corrosive vapors or soot.

This invention operates as follows: when a short-circuit occurs, the two contacts 12 and 14 will repel reaching the position 12 and 14*a*, respectively, illustrated in the three figures. Immediately after the contacts become opened by repulsion, an electric arc is established between the open contacts which are flanked by materials 28' and 28'' which are coated on the columns of the side assembly 18. The heat thus created by the arc will cause melting, vaporization and/or decomposition of material 28'', along with emission of gas which will urge or blow the arc thus contributing to its extinction.

As illustrated on FIG. 1, the layer of material 28'' being close to the more stationaly contact 14 which, upon repulsion due to a short-circuit, assumes the position indicated at 14*a*, urges the lower portion of the arc to the right, by driving it out of the magnetic assembly 18 and directing it toward an extinction assembly (not illustrated), while the layer of material 28' maintains the required insulation between the open contacts.

In FIG. 2 the layer of material 28'' is arranged in the center of the columns of the magnetic assembly 18, such that it will act on the central portion of the arc moving it to the right and driving it out of the magnetic assembly 18, while the two layers of material 28' maintain the required insulation between the open contacts.

As shown in FIG. 3, the plurality of layers of material 28'' alternated with layers of material 28' on the columns of the magnetic assembly 18, causes the arc thrust or blow action to be distributed all along the length of the assembly of material 28' maintains the required insulation between the open contacts.

The invention is not limited to the disclosed embodiments but is contemplated to cover all the equivalent solutions within the scope of the appended claims.

Having described our invention, what we claim as new and desire to secure by Letters Patent is:

1. An improved arrangement for enhancing arc blow out and extinction between the contacts of circuit breakers of the type containing an arc motivating assembly which includes two opposing columns of magnetic plates along said contacts, wherein the improvement comprises:

first and second insulating materials on said magnetic plates, said first insulating materials providing high dielectric strength and high arc resistance without low electrical resistance track formation, said second insulating material becoming vaporized upon the occurence of an arc between said contacts and emitting gas to assist in the blow out and extinction of said arc without maintaining its insulating properties after exposure to said arc.

2. The improved arrangement, according to claim 1, wherein said first and second insulating materials are arranged alternatively in layers such that two layers of said first insulating material are arranged one layer above and one layer below a layer of said second insulating material.

3. The improved arrangement according to claim 1, wherein said first and second insulating materials are arranged alternatively such that each layer of said first insulating material is followed by a layer of said second insulating material.

4. The improved arrangement according to claim 1 wherein said second insulating material comprises a flame-retarding halogen-free polypropylene.

5. The improved arrangement according to claim 4 wherein said second insulating material includes silica-based additive for flame retardancy.

6. The improved arrangement according to claim 1 wherein said first insulating material comprises silicone rubber.

* * * * *